US011090530B1

(12) United States Patent
Aguilar

(10) Patent No.: US 11,090,530 B1
(45) Date of Patent: Aug. 17, 2021

(54) INTERCHANGEABLE SHAFTS FOR GOLF PUTTER

(71) Applicant: Anthony Aguilar, Arvada, CO (US)

(72) Inventor: Anthony Aguilar, Arvada, CO (US)

( * ) Notice: Subject to any disclaimer, the term of this patent is extended or adjusted under 35 U.S.C. 154(b) by 0 days.

(21) Appl. No.: 17/067,677

(22) Filed: Oct. 10, 2020

(51) Int. Cl.
*A63B 53/02* (2015.01)
*A63B 53/04* (2015.01)

(52) U.S. Cl.
CPC ..... *A63B 53/02* (2013.01); *A63B 53/0487* (2013.01)

(58) Field of Classification Search
CPC ..... A63B 53/02; A63B 53/007
USPC ..... 473/288, 305, 307, 313
See application file for complete search history.

(56) References Cited

U.S. PATENT DOCUMENTS 1,601,770 A * 10/1926 Reach ..... A63B 53/02 473/307
4,832,340 A * 5/1989 Pickering ..... A63B 53/02 473/313
5,039,098 A * 8/1991 Pelz ..... A63B 53/02 473/306
5,388,827 A * 2/1995 Reynolds, Jr. ..... A63B 60/46 473/306
5,513,844 A * 5/1996 Ashcraft ..... A63B 53/02 473/288
5,533,725 A * 7/1996 Reynolds, Jr. ..... A63B 53/02 473/307
6,039,659 A * 3/2000 Hamm ..... A63B 53/02 473/306
6,089,991 A * 7/2000 Yeh ..... A63B 53/02 473/305
6,110,055 A * 8/2000 Wilson ..... A63B 53/047 473/239
6,168,534 B1 * 1/2001 Schultz ..... A63B 53/06 473/299
6,287,215 B1 * 9/2001 Fisher ..... A63B 53/007 473/309
6,561,919 B2 * 5/2003 Edel ..... A63B 53/02 473/250
6,620,053 B2 * 9/2003 Tseng ..... A63B 60/00 473/297
6,966,847 B2 * 11/2005 Lenhof ..... A63B 53/007 473/305
7,159,864 B1 * 1/2007 Fleury ..... A63B 67/02 273/108.2
7,207,897 B2 * 4/2007 Burch ..... A63B 53/02 473/288
7,566,279 B2 * 7/2009 Nakashima ..... A63B 60/00 473/288

(Continued)

FOREIGN PATENT DOCUMENTS

JP 02049673 A * 2/1990 ..... A63B 53/02
JP 05111553 A * 5/1993 ..... A63B 60/00

(Continued)

*Primary Examiner* — Alvin A Hunter
(74) *Attorney, Agent, or Firm* — Barber Legal; Craig W. Barber

(57) ABSTRACT

A flexible putter shaft may be interchanged with a stiff putter shaft even though the two shafts have markedly different properties including different diameters, different degrees of elasticity, and so on. An external adapter for a flexible putter shaft and an internal adapter for a stiff shaft allow either one to be fastened through a customized hole on the hosel of a putter head using a locking fastener and tool.

9 Claims, 20 Drawing Sheets

(56) References Cited

U.S. PATENT DOCUMENTS

| | | | | |
|---|---|---|---|---|
| 7,789,766 | B2 * | 9/2010 | Morris | A63B 60/00 473/246 |
| 7,874,934 | B2 * | 1/2011 | Soracco | A63B 60/42 473/307 |
| 7,878,921 | B2 * | 2/2011 | Bennett | A63B 53/047 473/307 |
| 7,931,542 | B2 * | 4/2011 | Kusumoto | A63B 60/54 473/288 |
| 8,142,306 | B2 * | 3/2012 | De La Cruz | A63B 60/00 473/288 |
| 8,235,834 | B2 * | 8/2012 | De La Cruz | A63B 53/02 473/307 |
| 8,419,567 | B2 * | 4/2013 | Jertson | A63B 53/02 473/307 |
| 8,449,404 | B2 * | 5/2013 | Thomas | A63B 53/0466 473/307 |
| 8,535,173 | B2 * | 9/2013 | Golden | A63B 53/02 473/307 |
| 8,727,905 | B2 * | 5/2014 | Murphy | A63B 53/0466 473/307 |
| D708,275 | S | 7/2014 | Aguilar | |
| 8,961,330 | B2 * | 2/2015 | Zimmerman | A63B 53/02 473/307 |
| 9,022,879 | B2 * | 5/2015 | Sato | A63B 53/02 473/307 |
| 9,403,066 | B2 * | 8/2016 | Esposito | A63B 53/0487 |
| 9,403,067 | B2 * | 8/2016 | Zimmerman | A63B 53/0466 |
| 9,724,571 | B2 * | 8/2017 | Burch | A63B 53/02 |
| 10,010,768 | B2 * | 7/2018 | Mizutani | A63B 53/02 |
| D869,581 | S | 12/2019 | Aguilar | |
| 10,716,972 | B1 * | 7/2020 | Holtzman | A63B 53/02 |
| 10,843,059 | B2 * | 11/2020 | Koch | A63B 69/3632 |
| 10,881,914 | B2 * | 1/2021 | Hamburger | A63B 53/065 |

FOREIGN PATENT DOCUMENTS

| | | | | | |
|---|---|---|---|---|---|
| JP | 06031015 | A | * | 2/1994 | B29C 65/76 |
| JP | 08299511 | A | * | 11/1996 | A63B 53/12 |
| JP | 2002291945 | A | * | 10/2002 | A63B 53/00 |
| JP | 2002306651 | A | * | 10/2002 | A63B 53/02 |
| JP | 2002306652 | A | * | 10/2002 | A63B 53/10 |
| JP | 2008259862 | A | * | 10/2008 | A63B 53/02 |
| JP | 2009142676 | A | * | 7/2009 | A63B 53/10 |
| JP | 2011087801 | A | * | 5/2011 | A63B 60/00 |
| JP | 2012081250 | A | * | 4/2012 | A63B 53/02 |
| JP | 2012086010 | A | * | 5/2012 | A63B 53/02 |
| JP | 2012152331 | A | * | 8/2012 | A63B 53/02 |
| JP | 2012165864 | A | * | 9/2012 | A63B 53/02 |
| JP | 2013230205 | A | * | 11/2013 | A63B 53/02 |
| JP | 2014113251 | A | * | 6/2014 | A63B 53/02 |
| JP | 2014113253 | A | * | 6/2014 | A63B 53/0466 |
| JP | 2015008820 | A | * | 1/2015 | A63B 53/04 |
| JP | 2015019696 | A | * | 2/2015 | A63B 53/02 |

* cited by examiner

INTERCHANGEABLE SHAFTS FOR GOLF PUTTER

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but reserves all copyright rights whatsoever. 37 CFR 1.71(d).

CROSS-REFERENCE TO RELATED APPLICATIONS

N/A

FIELD OF THE INVENTION

This invention relates generally to golf and specifically to interchangeable shafts having different characteristics, for a putter.

STATEMENT REGARDING FEDERALLY FUNDED RESEARCH

This invention was not made under contract with an agency of the US Government, nor by any agency of the US Government.

BACKGROUND OF THE INVENTION

The traditional putter has a stiff metal shaft connecting the handgrip to the head. This is permanently secured in place, and the putter is the complete unit without any ability to switch between shafts.

One more recent innovation is the flexible putter, used for training by forcing beginners to adapt a smoother and more professional swing.

However, it is necessary to purchase the training putter as a separate unit, since the shafts cannot be interchanged. This increases the cost of the equipment for learning and playing golf and serves as a barrier to learning proper technique.

An example of a prior art putter is shown in FIG. 2. It is seen that the putter and shaft are a single unit.

A prior art putter head is shown in FIG. 3. While the shaft is not shown, it is a flexible shaft only (or a stiff shaft only) as the shaft is permanently attached to the head at the time of manufacture.

A driver and driver shaft are shown in FIGS. 4 and 5. It is known in the art to provide a shaft with multiple heads which can be attached to the driver by means of a screw.

It would be preferable to provide a putter which could use different shafts.

However, a flexible shaft of modern design is quite different from a traditional stiff putter shaft. The traditional putter shaft is rigid, and bends only under great force. Since putters are not used to administer hard impacts on the ball, this is never and it is regarded as beneficial to minimize the movement of the shaft. The traditional metal shaft tends to be about ⅜" in diameter and made of a rigid metal alloy, with a hollow core.

On the other hand, a modern flexible shaft is usually made of polymer material such as carbon fiber, and bends at the slightest motion. Such shafts are specifically designed for this high degree of flexibility: they are for training. The use of the resilient shaft disciplines the trainee to hold the putter steady from the instant that they first pick it up right through to the follow through of the swing. Such shafts tend to be around ¼" in diameter, with a much smaller void and a thicker cylindrical shell.

Obviously the differing characteristics of the different shafts require different attachment arrangements to the head, for example, a head having a hosel of a different size, with a different attachment mechanism on or within the hosel, and so forth.

In addition, since a training putter is literally designed to for a great degree of motion between grip and head, it is unusable in play and it is always assumed that the purpose of the training putter and the real play putter were so contradictory that one putter could not do both. This leads to the "pay for two putters" problem mentioned earlier.

It would be preferable to provide a mechanism to allow different sizes and materials of shafts to be used with a single putter/putter head.

It would be preferable to allow different diameter shafts to be used with one putter head, both rigid and flexible.

It would also be preferable to allow shafts of different materials to be used, without having a metal hosel cut into and wear away a soft polymer shaft, nor allow a hard metal shaft to damage a hypothetical hosel made of polymer material.

It would also be preferable to provide a securing mechanism which allows securing to either the exterior of a slender shaft or the interior of a thick shaft.

All of these aspects and objectives will be provided by means of the present invention, as disclosed herein.

SUMMARY OF THE INVENTION

General Summary

The present invention teaches a that flexible putter shaft may be interchanged with a stiff putter shaft even though the two shafts have different diameters, different degrees of flexibility, and so on.

An external adapter is provided for a flexible putter shaft having a narrower diameter such as 0.25 inch: the external adapter may be flexible itself since the shaft is designed to flex and vibrate.

An internal adapter for a stiff shaft allows a locking fastener to pass through a customized hole on the hosel of a putter head, then into the internal adapter and thus lock the stiff shaft into place.

By this means the same putter head can be used as a flexible training putter and also as a game putter.

Summary in Reference to Claims

It is therefore another aspect, advantage, objective and embodiment of the invention, in addition to those discussed previously, to provide a putter head device allowing use of shafts having different characteristics, the putter head device comprising:

a putter head having a body, the body having a vertical hosel extending upward from the body;

a hole passing through the hosel, the hole having a first internal diameter;

a stiff putter shaft having a cylindrical body with a stiff putter shaft internal diameter and a stiff putter shaft external diameter;

a flexible putter shaft having a body with a flexible putter shaft external diameter and a flexible putter shaft internal diameter;

a stiff putter shaft adapter having a stiff putter shaft adapter internal diameter and a stiff putter shaft external diameter;

a flexible putter shaft adapter having a flexible putter shaft adapter internal diameter and a flexible putter shaft external diameter;

a locking fastener having a locking fastener external diameter;

the locking fastener outer diameter being equal to the flexible putter shaft inner diameter and dimensioned and configured to physically engage thereto;

the locking fastener outer diameter further being equal to the stiff putter shaft adapter internal diameter and dimensioned and configured to physically engage thereto;

the stiff putter shaft adapter outer diameter further being equal to the stiff putter shaft inner diameter;

the stiff putter shaft outer diameter further being equal to the hole internal diameter; the flexible putter shaft adapter inner diameter further being equal to the flexible putter shaft outer diameter;

the flexible putter shaft adapter outer diameter further being equal to the hole internal diameter;

whereby the locking fastener may in a first mode of use be passed through the hole into the flexible putter shaft inner diameter and physically engaged thereto, with the flexible putter shaft adapter outer diameter disposed within the hole, thereby securing the flexible putter shaft to the putter head, and may in a second mode be passed through the hole into the stiff putter shaft adapter inner diameter and physically engaged thereto, with the stiff putter shaft outer diameter disposed within the hole, thereby securing the stiff putter shaft to the putter head.

It is therefore another aspect, advantage, objective and embodiment of the invention, in addition to those discussed previously, to provide a putter head device wherein the locking fastener further comprises external threading, and the internal diameter of the flexible putter shaft further comprises internal threading, and the internal diameter of the stiff putter shaft adapter further comprises internal threading.

It is therefore another aspect, advantage, objective and embodiment of the invention, in addition to those discussed previously, to provide a putter head device wherein the threading of the locking fastener, the flexible putter shaft and the stiff putter shaft adapter all further comprise interrupted threading.

It is therefore another aspect, advantage, objective and embodiment of the invention, in addition to those discussed previously, to provide a putter head device wherein the stiff putter shaft adapter is permanently affixed within the inner diameter of the stiff putter shaft.

It is therefore another aspect, advantage, objective and embodiment of the invention, in addition to those discussed previously, to provide a putter having interchangeable putter shafts, the putter comprising:

a putter head having a body, the body having a vertical hosel extending upward from the body;

a hole passing through the hosel, the hole having a first internal diameter;

a stiff putter shaft having a cylindrical body with a stiff putter shaft internal diameter and a stiff putter shaft external diameter, the stiff putter shaft further having a handgrip;

a flexible putter shaft having a body with a flexible putter shaft external diameter and a flexible putter shaft internal diameter, the flexible putter shaft further having a handgrip;

a stiff putter shaft adapter having a stiff putter shaft adapter internal diameter and a stiff putter shaft external diameter;

a flexible putter shaft adapter having a flexible putter shaft adapter internal diameter and a flexible putter shaft external diameter;

a locking fastener having a locking fastener external diameter;

the locking fastener outer diameter being equal to the flexible putter shaft inner diameter and dimensioned and configured to physically engage thereto;

the locking fastener outer diameter further being equal to the stiff putter shaft adapter internal diameter and dimensioned and configured to physically engage thereto;

the stiff putter shaft adapter outer diameter further being equal to the stiff putter shaft inner diameter;

the stiff putter shaft outer diameter further being equal to the hole internal diameter; the flexible putter shaft adapter inner diameter further being equal to the flexible putter shaft outer diameter;

the flexible putter shaft adapter outer diameter further being equal to the hole internal diameter;

whereby the locking fastener may in a first mode of use be passed through the hole into the flexible putter shaft inner diameter and physically engaged thereto, with the flexible putter shaft adapter outer diameter disposed within the hole, thereby securing the flexible putter shaft to the putter head, and may in a second mode be passed through the hole into the stiff putter shaft adapter inner diameter and physically engaged thereto, with the stiff putter shaft outer diameter disposed within the hole, thereby securing the stiff putter shaft to the putter head.

It is therefore another aspect, advantage, objective and embodiment of the invention, in addition to those discussed previously, to provide a putter wherein the locking fastener further comprises external threading, and the internal diameter of the flexible putter shaft further comprises internal threading, and the internal diameter of the stiff putter shaft adapter further comprises internal threading.

It is therefore another aspect, advantage, objective and embodiment of the invention, in addition to those discussed previously, to provide a putter wherein the threading of the locking fastener, the flexible putter shaft and the stiff putter shaft adapter all further comprise interrupted threading.

It is therefore another aspect, advantage, objective and embodiment of the invention, in addition to those discussed previously, to provide a putter wherein the stiff putter shaft adapter is permanently affixed within the inner diameter of the stiff putter shaft.

It is therefore another aspect, advantage, objective and embodiment of the invention, in addition to those discussed previously, to provide a putter comprising:

the locking fastener having a head portion;

an accessory tool which is dimensioned and configured to engage to the locking fastener head portion.

INDEX TO REFERENCE NUMERALS

Figure 1:
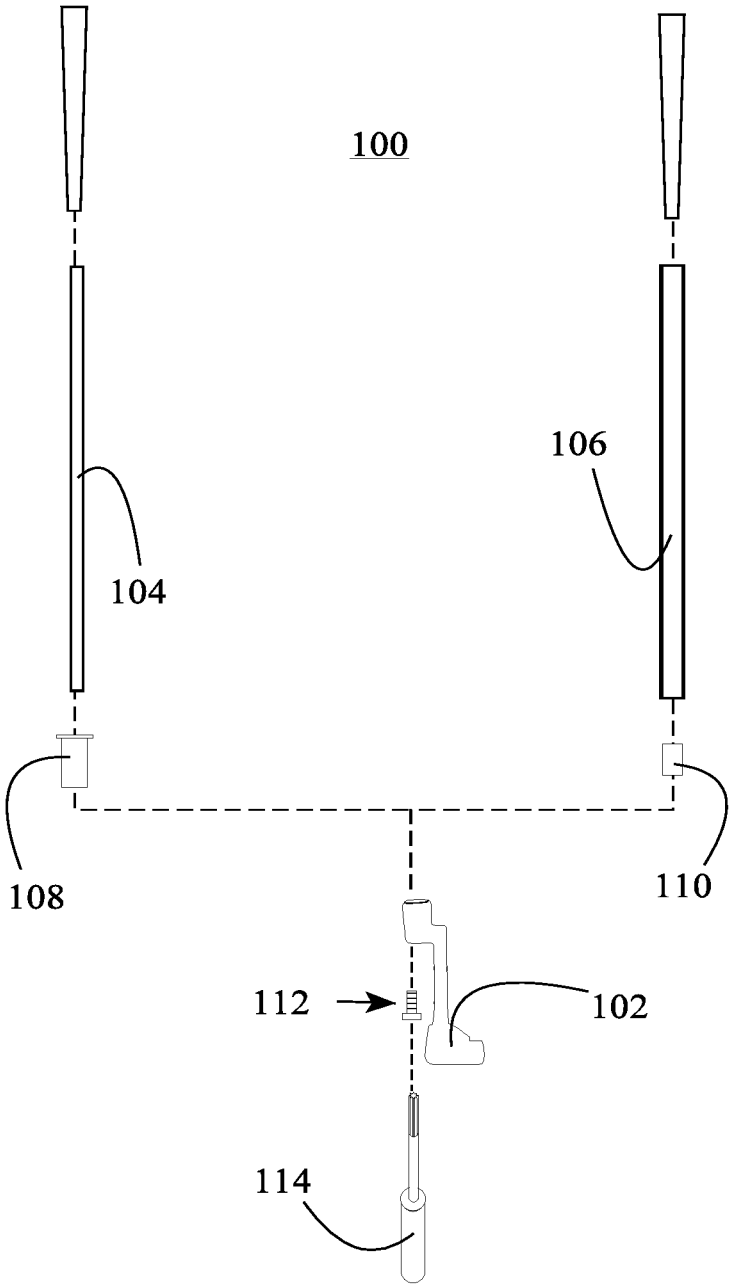
FIG. 1 is an exploded view of the components of the present invention.

FIG. 1:
Flexible putter shaft interchange 100
Putter head 102
Flexible putter shaft 104
Stiff putter shaft 106
Adapter for flexible putter shaft 108
Adapter for stiff putter shaft 110
Locking fastener 112
Locking fastener tool 114
FIGS. 2 through 5:
FIGS. 2 through 5 are from other US patent documents and reference numbers are not relevant to the present application.
FIG. 6:
Flexible putter shaft, polymer 602
Stiff putter shaft, metal 604
OD of flexible putter shaft 606
OD of stiff putter shaft 608
ID of stiff putter shaft 610
FIGS. 7 through 10:
Adapter for flexible shaft 700
OD of adapter for flexible shaft 702
(Equals 608)
ID of adapter for flexible shaft 704
(Equals 606)
Aperture through adapter for flexible shaft 706
FIGS. 11 through 14:
Adapter for stiff putter shaft 800
Aperture through adapter for locking fastener 802
Internal threading 804
OD of adapter for stiff putter shaft 806
(Equals 610)
FIGS. 15 through 18:
Lock fastener 850
FIG. 19:
Head 900
Hosel 902
Hole 904
FIG. 20:
Tool 1100
Tooltip 1102
Handle 1104

DETAILED DESCRIPTION

Glossary

A head is the part of the putter at the lower end of the shaft, used to hit the golf ball during practice or play.

A grip is the part of the putter at the upper end of shaft, dimensioned and configured for easy and secure gripping by human hands.

A hosel is the vertical projection from the putter head which extends upward from the body of the putter head, and which is engaged to the shaft. In prior art designs, the attachment to the shaft is permanent and is achieved by means of an adhesive such as solder, glue, welding, or other means.

Polymers include normal carbon based molecules arranged in long sequences of mers, including obviously uniform consistency materials such as plastics, non-uniform fiber composites, mixtures of plastics, mixes of plastics, fibers, binders, adhesives and other additives and so forth.

The usual metal used for game putters is steel alloy, but any rigid material, metallic or non-metallic, may be used.

OD stands for outer diameter. ID stands for inner diameter.

End Glossary

FIG. 1 is an exploded view of the components of the present invention. Flexible putter shaft interchange 100 consists of putter head 102, flexible putter shaft 104 and stiff putter shaft 106. The flexible putter shaft 104 might have an outer diameter (OD) of 0.25 (¼) inch. The stiff putter shaft 106 may have a much larger OD of 0.35 or 0.375 inch, that is, ⅓ to ⅜ of an inch. Obviously either may be more or less, but the general point remains that the modern flexible shaft tends to be of completely different diameter to the rigid shaft.

In addition, while the flexible shaft may have no internal bore (not be hollow, not be a cylinder), or may be a cylinder, the stiff putter shaft is almost always a cylinder having an ID just smaller than the OD, for example, an ID of 0.34 inch or the like.

In addition the flexible shaft 104 for practice is a softer material which requires different methods of securing from the steel material of the typical rigid shaft 106 for play.

While these (with handgrips, the tool and so forth) are the major components, there are several smaller components as well. These smaller elements of the invention allow it to cope with materials which must be secured differently or are different sizes.

The external adapter 108 for the flexible putter shaft 104 is made of a resilient material such as hard rubber. This prevents the flexible putter shaft 104 from wearing against the metal head of the putter and becoming worn, cracked or otherwise damaged or loose. In addition, this allows the invention to be secured, in the practice mode (flexible shaft 104) with only the adapter 108 and a frictional fit to the hole through the hosel (discussed in reference to FIGS. 7 through 10 and FIG. 16), without needing a locking fastener to pass into the flexible shaft 104. In other embodiments, the locking fastener may enter the flexible shaft 104 and engage thereto physically, for example by means of detents or threading.

On the other hand, the internal adapter 110 for the stiff putter shaft 106 may actually inside of the bore of the shaft 106 and be permanently affixed therein, for example, at the time of manufacture. The internal adapter then has internal threading which may be physically engaged by an externally threaded locking fastener 112. Locking fastener tool 114 may physically engage the head of the locking fastener 112 to allow the locking fastener to be adjusted, secured, or removed by hand during the process of changing shafts of the putter.

Figure 2:
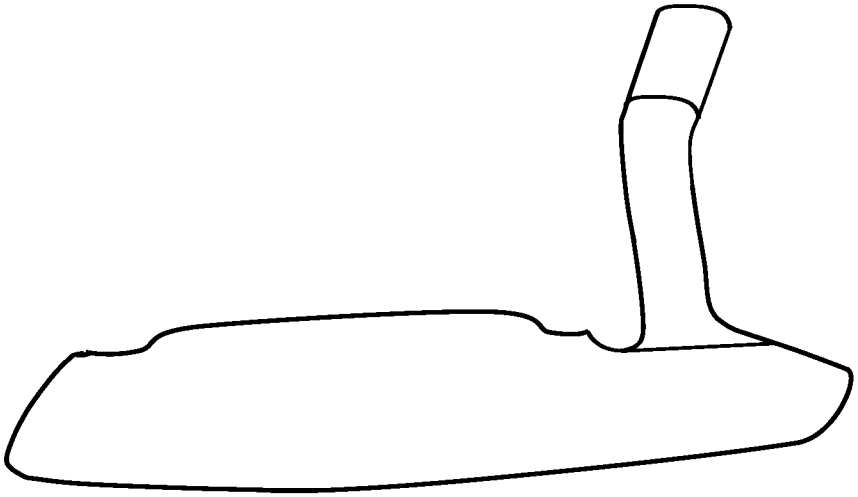
Fig. 2 PRIOR ART
FIG. 2 is a PRIOR ART putter.
Figure 3:
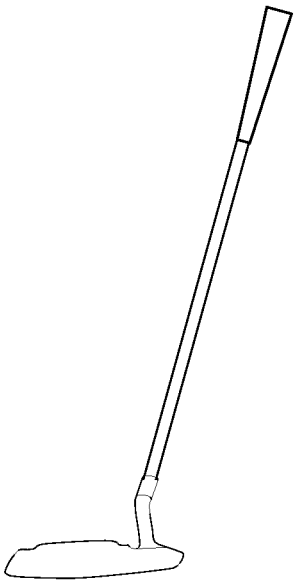
Fig. 3 PRIOR ART
FIG. 3 is a PRIOR ART putter head.

FIG. 2 is a PRIOR ART putter, and FIG. 3 is a PRIOR ART putter head. Obviously the putter and putter head are joined permanently.

Figure 4:
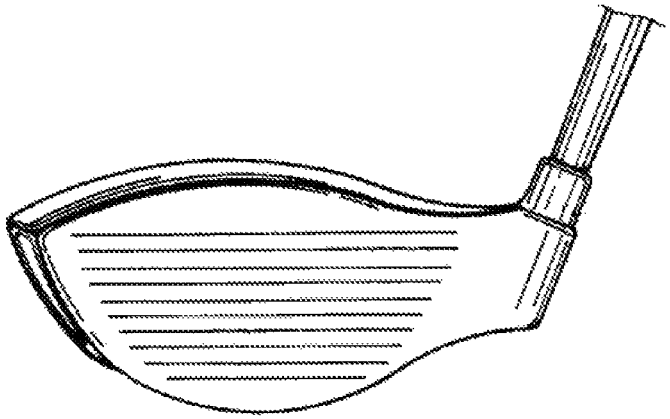
Fig. 4 PRIOR ART
FIG. 4 is a PRIOR ART driver.
Figure 5:
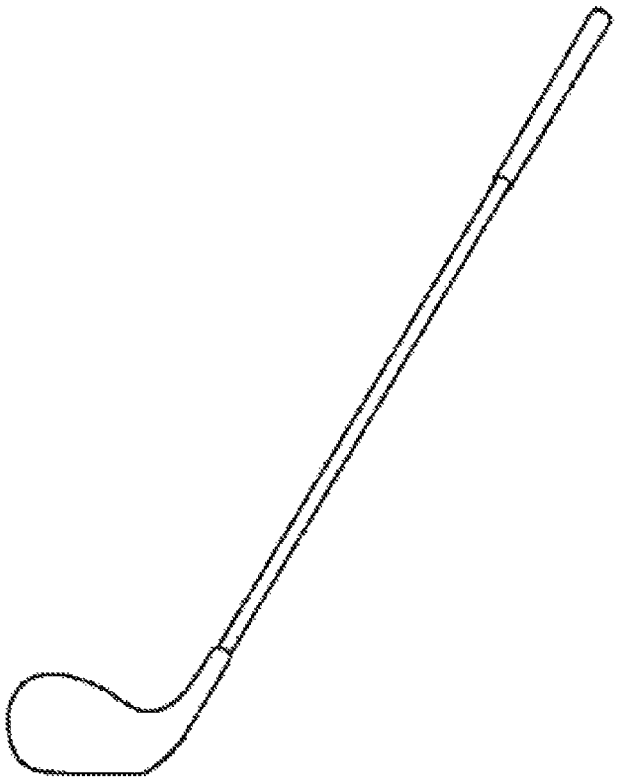
Fig. 5 PRIOR ART
FIG. 5 is a PRIOR ART driver head.
Figure 6:
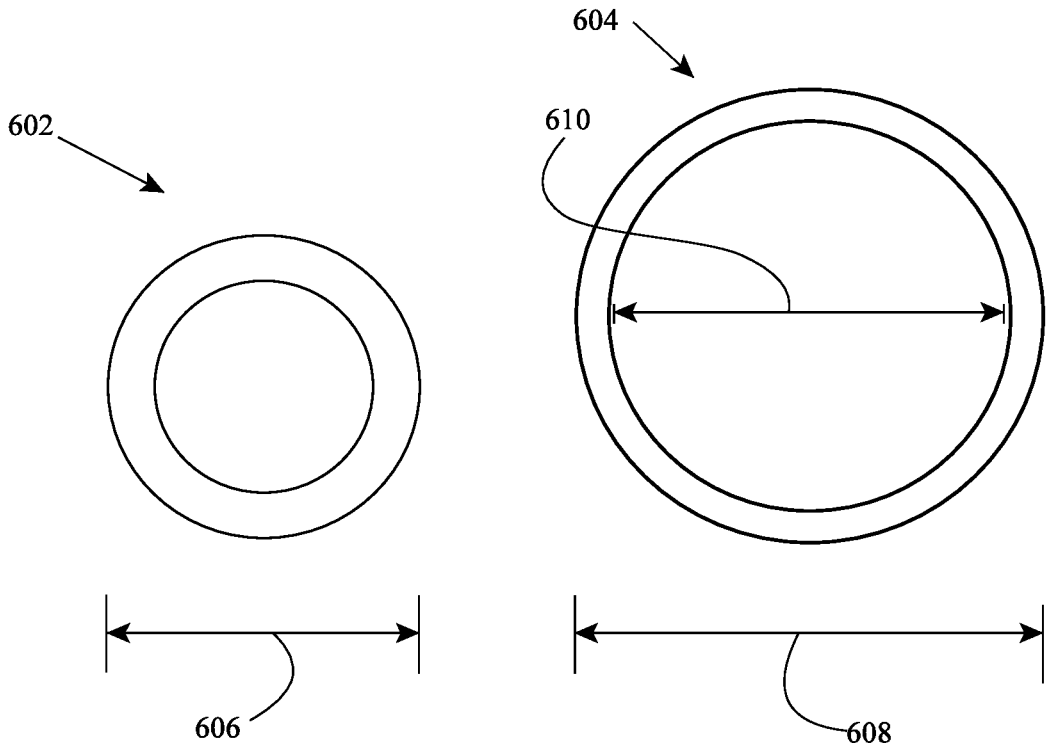
FIG. 6 is an end view of two putter shafts: a first flexible shaft of smaller diameter than normal and thicker construction, such as polymer, and a second stiff metal shaft of different dimensions.

FIG. 4 is a PRIOR ART driver and FIG. 5 is a PRIOR ART driver head. In this case it is known in the prior art to provide a single driver shaft with multiple heads, along with a screw to secure a selected head to the single shaft. However, such systems cannot accommodate different diameters of shafts, do not even provide multiple shafts, do not accommodate training shafts, do not teach the use of an internal adapter and cannot even accept an external adapter.

FIG. 6 is an end view of two putter shafts: a first flexible shaft of smaller diameter than normal and thicker construction, such as polymer, and a second stiff metal shaft of different dimensions. Flexible putter shaft 602 is a polymer material and usually has thick walls or is in fact solid, with no central void at all, so it has only OD 606. By virtue of being a flexible material and having a narrow cross-section (small diameter) it is quite flexible, forcing golf learners to handle it properly and in a controlled manner prescribed by a pro instructor. However, it is not ideal for actual play, much less for high level play.

Stiff putter shaft 604 is metal and has a larger diameter, these properties make it quite stiff. It is cylindrical (has a central void) and thus has not only the OD 608 but also the inner diameter (ID) 610.

Clearly it is not possible by conventional golf related technology to fit these two disparate materials and sizes into a single socket.

Figure 7:
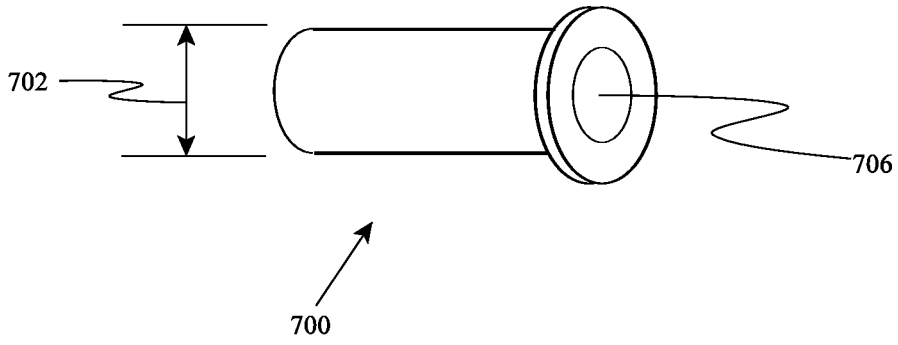
FIG. 7 is an orthogonal view of an adapter for a flexible putter shaft according to the present invention.
Figure 8:
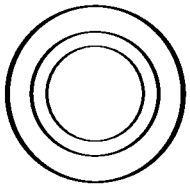
FIG. 8 is an end view of an adapter for a flexible putter shaft according to the present invention.
Figure 9:
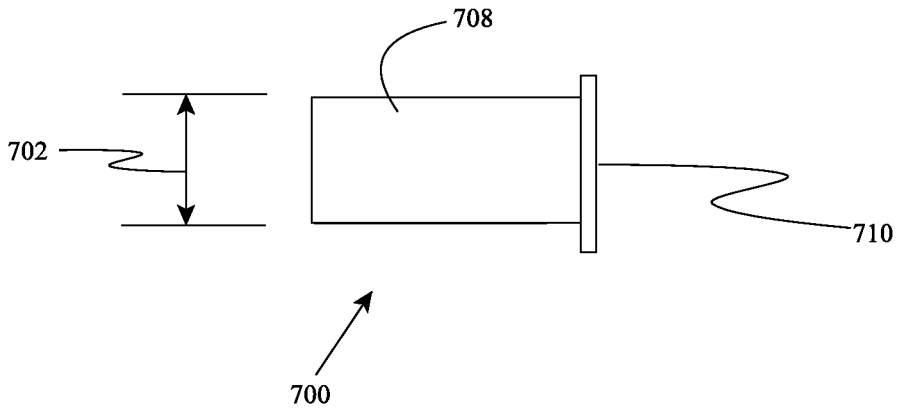
FIG. 9 is a side view of an adapter for a flexible putter shaft according to the present invention.
Figure 10:
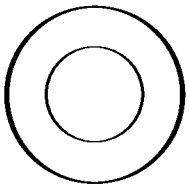
FIG. 10 is an opposite end view of an adapter for a flexible putter shaft according to the present invention.

FIG. 7 is an orthogonal view of an adapter for a flexible putter shaft according to the present invention. FIG. 8 is an end view of an adapter for a flexible putter shaft according to the present invention. FIG. 9 is a side view of an adapter for a flexible putter shaft according to the present invention. FIG. 10 is an opposite end view of an adapter for a flexible putter shaft according to the present invention. Adapter 700 for a flexible shaft will be external to the thin flexible shaft, so the OD 702 of adapter 700 will need to fit the hosel hole diameter, that is, it raises the OD of the flexible shaft 700 to match the OD 608 of the stiff shaft.

On the other hand, the inner (ID) diameter 704 of aperture 706 adapter 700 equals 606, that is, the OD of the flexible shaft, so that it can fit over the flexible shaft.

Once in place, the hard rubber adapter 700 protects the flexible shaft and holds it securely in place, while making the diameter match the hosel hole. In practice it has been found that since putting places very low impact loads onto the head of the putter, a frictional engagement is sufficient, however in embodiments the adapter 700 or the interior of the shaft may have internal threading and then use the same locking fastener as the stiff shafts.

Figure 11:
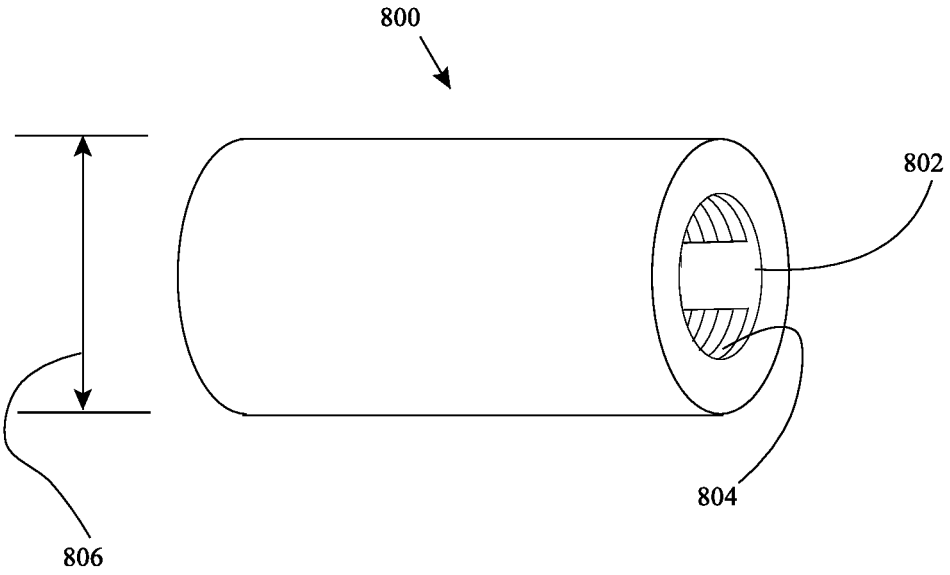
FIG. 11 is an orthogonal view of an adapter for a stiff putter shaft according to the present invention.
Figure 12:
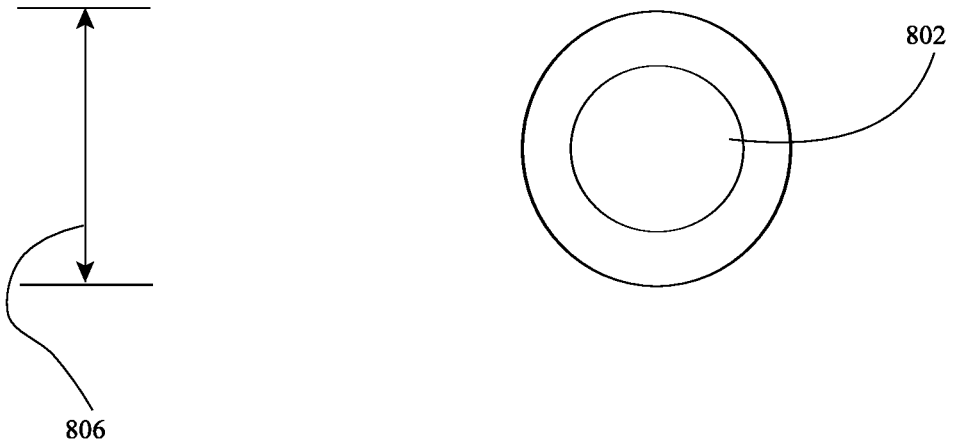
FIG. 12 is an end view of an adapter for a stiff putter shaft according to the present invention.
Figure 13:
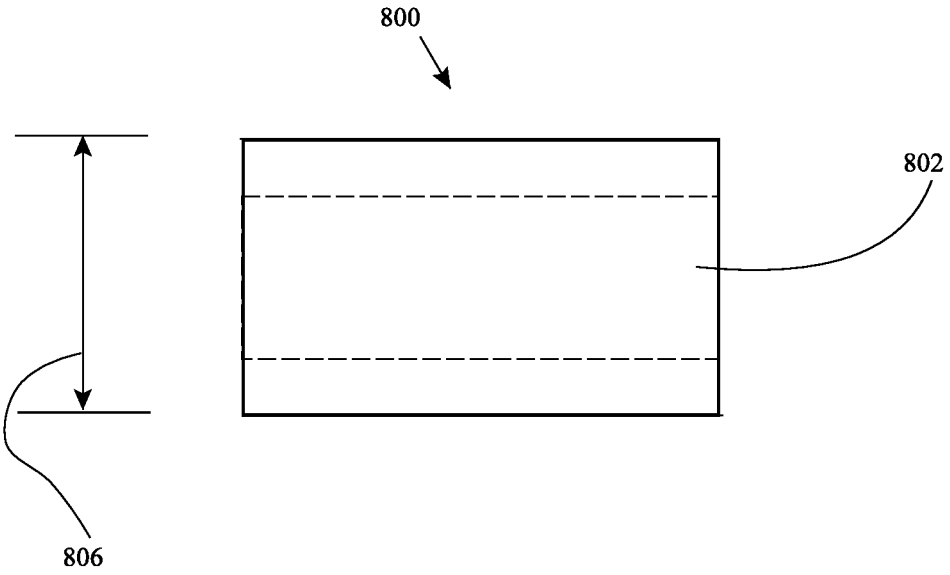
FIG. 13 is a side view of an adapter for a stiff putter shaft according to the present invention.
Figure 14:
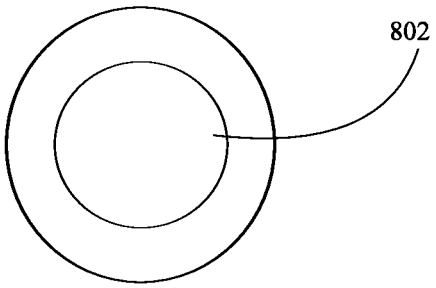
FIG. 14 is an opposite end view of an adapter for a stiff putter shaft according to the present invention.

FIG. 11 is an orthogonal view of an adapter for a stiff putter shaft according to the present invention. FIG. 12 is an end view of an adapter for a stiff putter shaft according to the present invention. FIG. 13 is a side view of an adapter for a stiff putter shaft according to the present invention. FIG. 14 is an opposite end view of an adapter for a stiff putter shaft according to the present invention.

In contrast to the external adapter 700 for the flexible shaft, this adapter 800 is an internal adapter designed to accept the locking fastener. Adapter 800 has an aperture 802 which accepts the locking fastener internally, and internal threading 804.

The OD of adapter 800 is equal to the ID 610 for stiff putter shaft, so that it may slide easily inside of the shaft.

Figure 15:
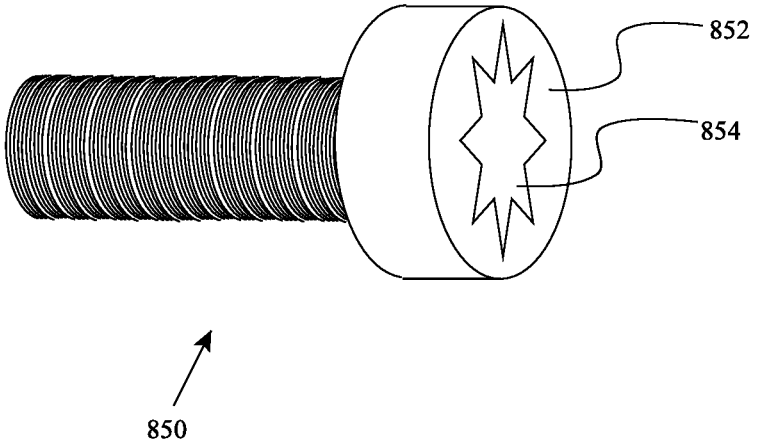
FIG. 15 is an orthogonal view of a locking fastener for a putter shaft according to the present invention.
Figure 16:
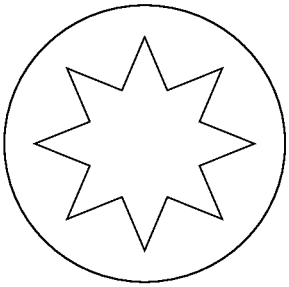
FIG. 16 is an end view of a locking fastener for a putter shaft according to the present invention.
Figure 17:
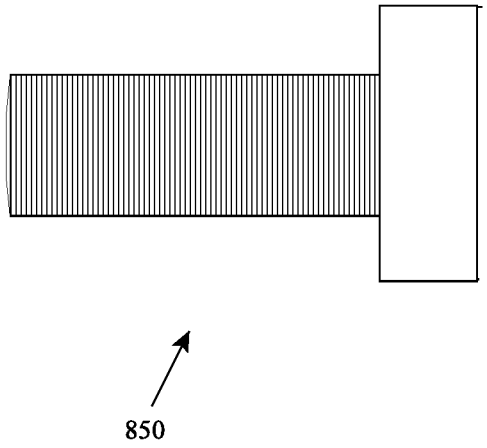
FIG. 17 is a side view of a locking fastener for a putter shaft according to the present invention.
Figure 18:
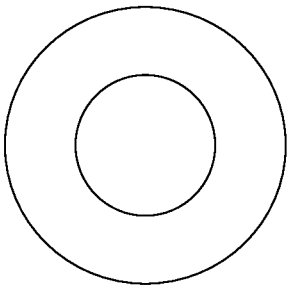
FIG. 18 is an opposite end view of a locking fastener for a putter shaft according to the present invention.

FIG. 15 is an orthogonal view of a locking fastener for a putter shaft according to the present invention. FIG. 16 is an end view of a locking fastener for a putter shaft according to the present invention. FIG. 17 is a side view of a locking fastener for a putter shaft according to the present invention. FIG. 18 is an opposite end view of a locking fastener for a putter shaft according to the present invention. Lock fastener 850 has a head which may be used to tighten, loosen, remove or insert the head. The head may be a screw head (with a straight or Phillips indent) or a hex head (suitable for use with an Allen wrench) or a six pointed star head of more modern type, a security head (having a small bump within the head or an odd number of star points or sides, etc).

Figure 19:
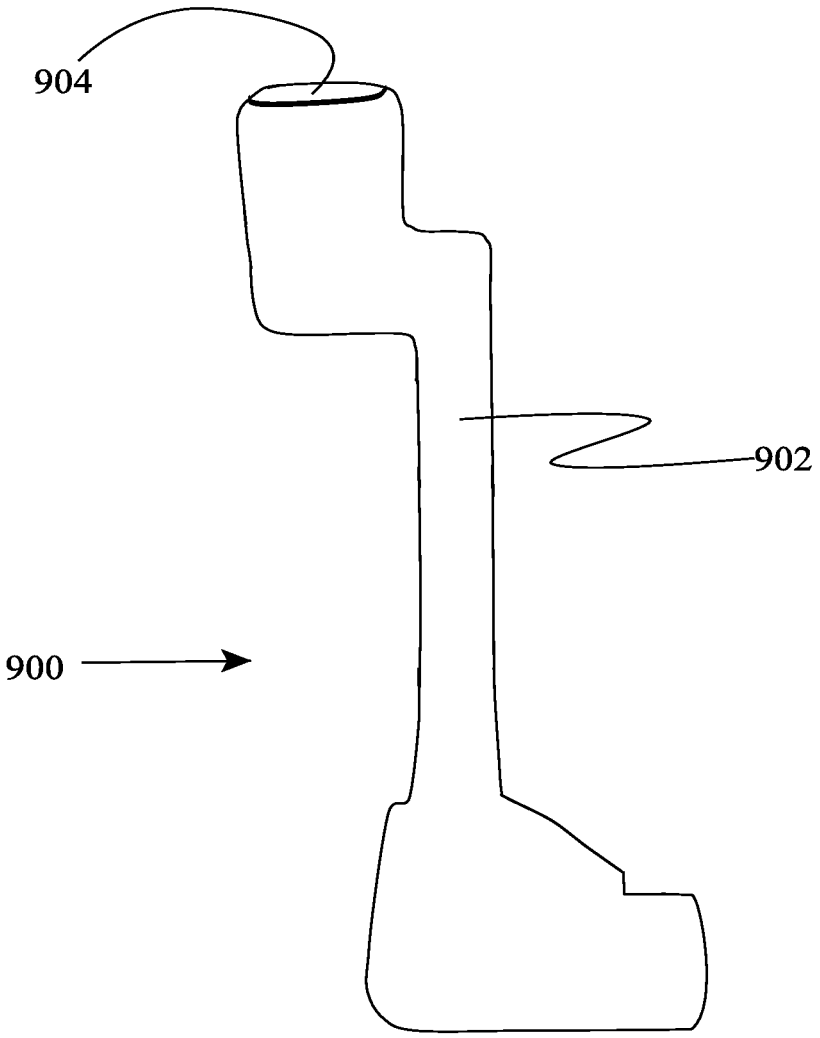
FIG. 19 is a view of a putter head with a hole passing through the hosel for an adapter and locking fastener of the present invention.

FIG. 19 is a view of a putter head with a hole passing through the hosel for an adapter and locking fastener of the present invention. Head 900 has the vertical hosel 902 projecting upward. At the top of the hosel 902, a hole 904 is created at the time of manufacture which matches the larger diameter of the stiff steel shaft. The hole 904 does not have to pass entirely through the hosel 902, but it may have a smaller section which does and which accepts the locking fastener. The locking fastener is inserted from under the hosel 902, upward into the hole 904 and then into the internal adapter of the stiff shaft or a similar structure on the flexible shaft.

Figure 20:
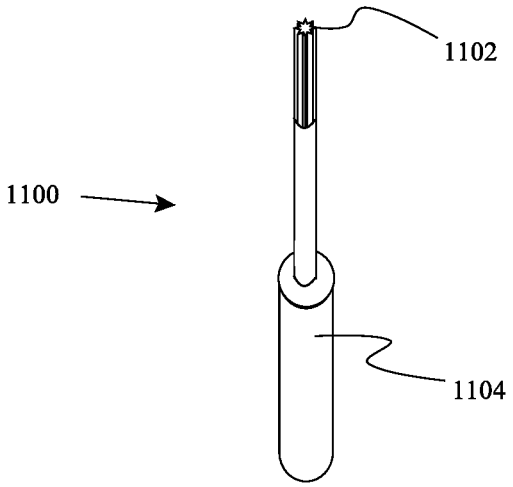
FIG. 20 is a picture of a locking fastener tightening and removal tool according to the present invention.

FIG. 20 is a diagram of a locking fastener tightening and removal tool according to the present invention. Tool 1100 has a tooltip 1102 which is dimensioned and configured to engage to the head of the locking fastener 850. This may be by means of a screwdriver head (flat or Phillips) or it may be a hex socket and drive, a six pointed star socket and drive, a security socket and drive, a bolt head and socket, and so forth.

Handle 1104 is simply dimensioned and configured to allow easy physical engagement by human hands.

The disclosure is provided to render practicable the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

Methods and components are described herein. However, methods and components similar or equivalent to those described herein can be also used to obtain variations of the present invention. The materials, articles, components, methods, and examples are illustrative only and not intended to be limiting.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art.

Having illustrated and described the principles of the invention in exemplary embodiments, it should be apparent to those skilled in the art that the described examples are illustrative embodiments and can be modified in arrangement and detail without departing from such principles. Techniques from any of the examples can be incorporated into one or more of any of the other examples. It is intended that the specification and examples be considered as exemplary only, with a true scope and spirit of the invention being indicated by the following claims.

What is claimed is:

1. A putter head device allowing use of shafts having different characteristics, the putter head device comprising:

a putter head having a body, the body having a vertical hosel extending upward from the body;

a hole passing through the hosel, the hole having a first internal diameter;

a stiff putter shaft having a cylindrical body with a stiff putter shaft internal diameter and a stiff putter shaft external diameter;

a flexible putter shaft having a body with a flexible putter shaft external diameter and a flexible putter shaft internal diameter;

a stiff putter shaft adapter having a stiff putter shaft adapter internal diameter and a stiff putter shaft external diameter;

a flexible putter shaft adapter having a flexible putter shaft adapter internal diameter and a flexible putter shaft external diameter;

a locking fastener having a locking fastener external diameter;

the locking fastener outer diameter being equal to the flexible putter shaft inner diameter and dimensioned and configured to physically engage thereto;

the locking fastener outer diameter further being equal to the stiff putter shaft adapter internal diameter and dimensioned and configured to physically engage thereto;

the stiff putter shaft adapter outer diameter further being equal to the stiff putter shaft inner diameter;

the stiff putter shaft outer diameter further being equal to the hole internal diameter;

the flexible putter shaft adapter inner diameter further being equal to the flexible putter shaft outer diameter;

the flexible putter shaft adapter outer diameter further being equal to the hole internal diameter;

whereby the locking fastener may in a first mode of use be passed through the hole into the flexible putter shaft inner diameter and physically engaged thereto, with the flexible putter shaft adapter outer diameter disposed within the hole, thereby securing the flexible putter shaft to the putter head, and may in a second mode be passed through the hole into the stiff putter shaft adapter inner diameter and physically engaged thereto, with the stiff putter shaft outer diameter disposed within the hole, thereby securing the stiff putter shaft to the putter head.

2. The putter head device of claim 1, wherein the locking fastener further comprises external threading, and the internal diameter of the flexible putter shaft further comprises internal threading, and the internal diameter of the stiff putter shaft adapter further comprises internal threading.

3. The putter head device of claim 2, wherein the threading of the locking fastener, the flexible putter shaft and the stiff putter shaft adapter all further comprise interrupted threading.

4. The putter head device of claim 2, wherein the stiff putter shaft adapter is permanently affixed within the inner diameter of the stiff putter shaft.

5. A putter having interchangeable putter shafts, the putter comprising:

a putter head having a body, the body having a vertical hosel extending upward from the body;

a hole passing through the hosel, the hole having a first internal diameter;

a stiff putter shaft having a cylindrical body with a stiff putter shaft internal diameter and a stiff putter shaft external diameter, the stiff putter shaft further having a handgrip;

a flexible putter shaft having a body with a flexible putter shaft external diameter and a flexible putter shaft internal diameter, the flexible putter shaft further having a handgrip;

a stiff putter shaft adapter having a stiff putter shaft adapter internal diameter and a stiff putter shaft external diameter;

a flexible putter shaft adapter having a flexible putter shaft adapter internal diameter and a flexible putter shaft external diameter;

a locking fastener having a locking fastener external diameter;

the locking fastener outer diameter being equal to the flexible putter shaft inner diameter and dimensioned and configured to physically engage thereto;

the locking fastener outer diameter further being equal to the stiff putter shaft adapter internal diameter and dimensioned and configured to physically engage thereto;

the stiff putter shaft adapter outer diameter further being equal to the stiff putter shaft inner diameter;

the stiff putter shaft outer diameter further being equal to the hole internal diameter;

the flexible putter shaft adapter inner diameter further being equal to the flexible putter shaft outer diameter;

the flexible putter shaft adapter outer diameter further being equal to the hole internal diameter;

whereby the locking fastener may in a first mode of use be passed through the hole into the flexible putter shaft inner diameter and physically engaged thereto, with the flexible putter shaft adapter outer diameter disposed within the hole, thereby securing the flexible putter shaft to the putter head, and may in a second mode be passed through the hole into the stiff putter shaft adapter inner diameter and physically engaged thereto, with the stiff putter shaft outer diameter disposed within the hole, thereby securing the stiff putter shaft to the putter head.

6. The putter of claim 5, wherein the locking fastener further comprises external threading, and the internal diameter of the flexible putter shaft further comprises internal threading, and the internal diameter of the stiff putter shaft adapter further comprises internal threading.

7. The putter of claim 6, wherein the threading of the locking fastener, the flexible putter shaft and the stiff putter shaft adapter all further comprise interrupted threading.

8. The putter of claim 6, wherein the stiff putter shaft adapter is permanently affixed within the inner diameter of the stiff putter shaft.

9. The putter of claim 8, further comprising:

the locking fastener having a head portion;

an accessory tool which is dimensioned and configured to engage to the locking fastener head portion.

* * * * *